United States Patent [19]

LeFrank

[11] Patent Number: 4,597,542

[45] Date of Patent: Jul. 1, 1986

[54] DEVICE FOR SIMULTANEOUS WINDING OF SEVERAL TAPES ON INDIVIDUAL REELS

[75] Inventor: Robert J. LeFrank, North Plainfield, N.J.

[73] Assignee: Ruesch Machine Company, Springfield, N.J.

[21] Appl. No.: 756,736

[22] Filed: Jul. 19, 1985

[51] Int. Cl.[4] ..... B65H 19/22

[52] U.S. Cl. ..... 242/64

[58] Field of Search ..... 242/64, 56 A, 180, 56.2, 242/56.9, 58.6, 79, 80

[56] References Cited

U.S. PATENT DOCUMENTS

| | | | |
|---|---|---|---|
| 1,506,327 | 8/1924 | Perrault | 242/64 |
| 2,202,883 | 6/1940 | Yoder | 242/64 X |
| 2,823,961 | 2/1958 | Showalter | 242/64 X |
| 3,486,708 | 12/1969 | Lamon | 242/64 X |
| 3,811,244 | 5/1974 | Killen et al. | 242/64 X |

*Primary Examiner*—John M. Jillions

*Attorney, Agent, or Firm*—Kane, Dalsimer, Kane, Sullivan and Kurucz

[57] ABSTRACT

An apparatus for winding several tapes simultaneously is provided with a central post and two members for holding reels. The members are rotatable in a horizontal plane between a winding and an unloading station so that while tape is being wound on the reels of one member at the winding station, full reels may be replaced with empty reels at the unloading station.

12 Claims, 4 Drawing Figures

DEVICE FOR SIMULTANEOUS WINDING OF SEVERAL TAPES ON INDIVIDUAL REELS

BACKGROUND OF THE INVENTION

1. Field of Invention

This invention pertains to a device for winding tapes on a first set of reels while a second set of reels is simultaneously unloaded.

2. Description of the Prior Art

It is frequently necessary to wind several web-like, relatively narrow materials on individual reels simultaneously. For example, magnetic tapes used in audio or video recordings are made by forming a relatively wide web in an endless sheet and then feeding the sheet into a slitting device which separates the sheet into a plurality of narrower tapes, usually having identical widths. The tapes are then wound simultaneously by a winding device on individual reels. However, once a predetermined length of tape is wound on each of the reels, the whole slitting line must be stopped while the full reel assemblies are removed from the winding device and replaced by empty reels. Furthermore, some of the assemblies of reels are rather heavy and therefore difficult to remove. Thus it is seen that the prior art tape winding devices are slow and labor intensive.

While some attempts have been made to devise better winders, none of these attempts proved to be completely acceptable. For example, in U.S. Pat. No. 3,921,929 a winding device is disclosed in which two diametrically opposed mandrels are rotatable between a winding and unloading position. However the disclosed device is cumbersome, needs special coupling and is able to move only one mandrel at a time.

OBJECTIVES AND SUMMARY OF THE INVENTION

In view of the deficiencies of the prior art tape winding devices, it is a principal objective of the present invention to provide a tape winding device which can rewind a plurality of tapes on reels while all full tapes can be simultaneously removed and replaced by empty reels.

Another objective is to provide a device which facilitates the replacement of reels.

Other objectives and advantages will become apparent from the following description of the invention. According to this invention, a tape winding device comprises a vertical post forming a T with a horizontal element. At its extreme ends the horizontal element is provided with means for holding reels positioned for rotation along horizontal axes. There is also provided a winding station with means for engaging and rotating the reels, and an unloading station for replacing full reels with empty reels. The horizontal element with the reel holding means is rotatable between said stations.

DETAILED DESCRIPTION OF THE INVENTION

Figure 1:
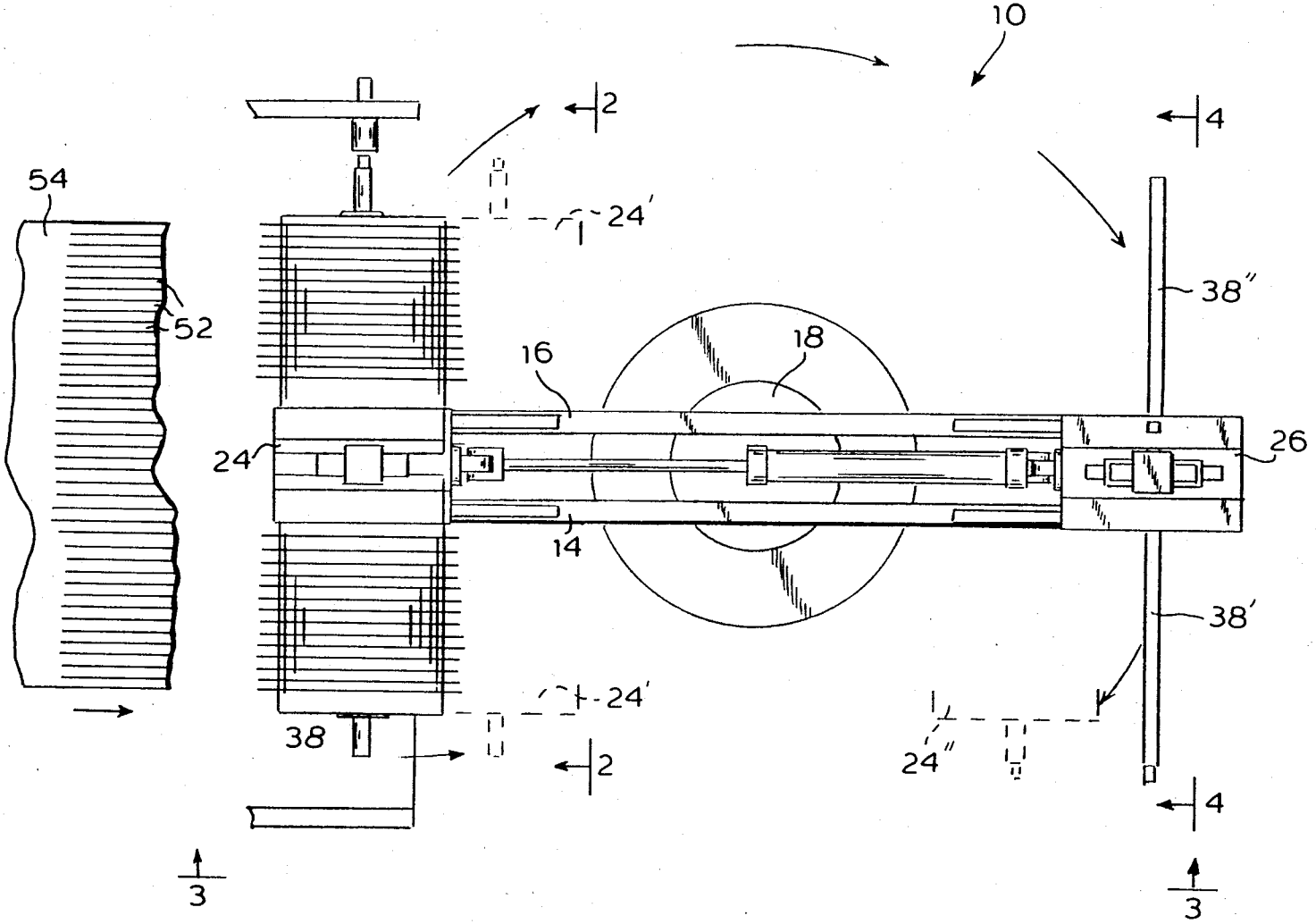
FIG. 1 shows a plan view of the tape winder constructed in accordance with the invention.
Figure 3:
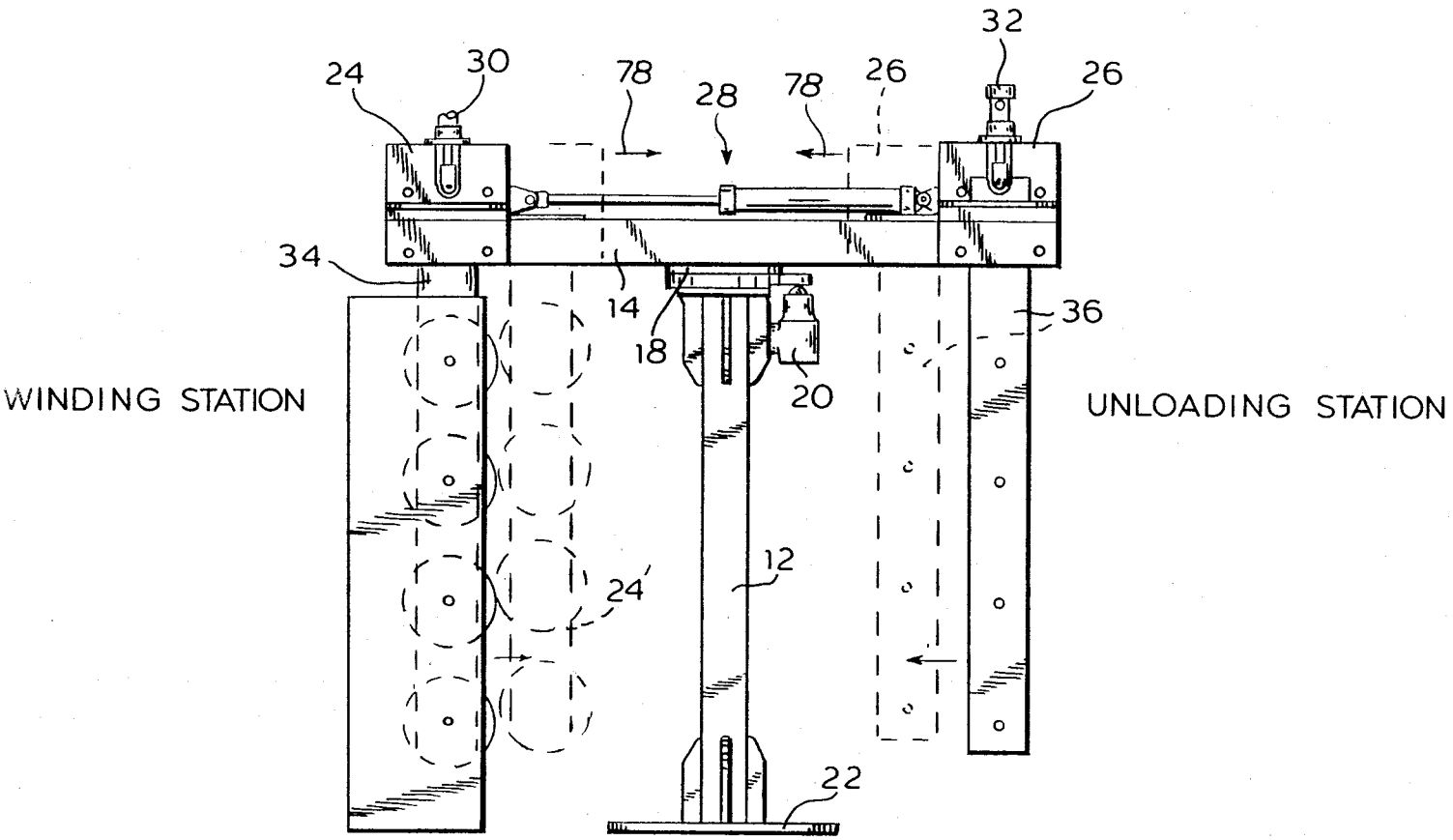
FIG. 3 shows a side view of the device of FIG. 1 along line 3—3, the spindle holders being retracted.

Turning now to the drawings, a tape winding device 10 comprises a vertical post 12 with parallel, horizontal beams 14 and 16 mounted on the shaft to form a T as shown in FIGS. 1 and 3. The two beams 14, 16 are mounted on a circular plate 18 rotatable around post 12 by a stationary motor 20 mounted on the post. At its base, the post has a wide circular base plate 22 for securing the post to the floor.

Mounted at the ends of the two beams are two spindle holders 24 and 26 which extend vertically downwards from the beams as shown. The spindle holders 24, 26 rest slidable on the beams and may be moved in unison toward or away from shaft 12 by a piston-and-rod assembly 28. For reasons described below, the spindle holders are also provided with two additional pneumatic pistons 30 and 32 respectively for selectively lifting and lowering the spindle holder bars 34, 36 vertically with respect to beams 14, 16.

Figure 2:
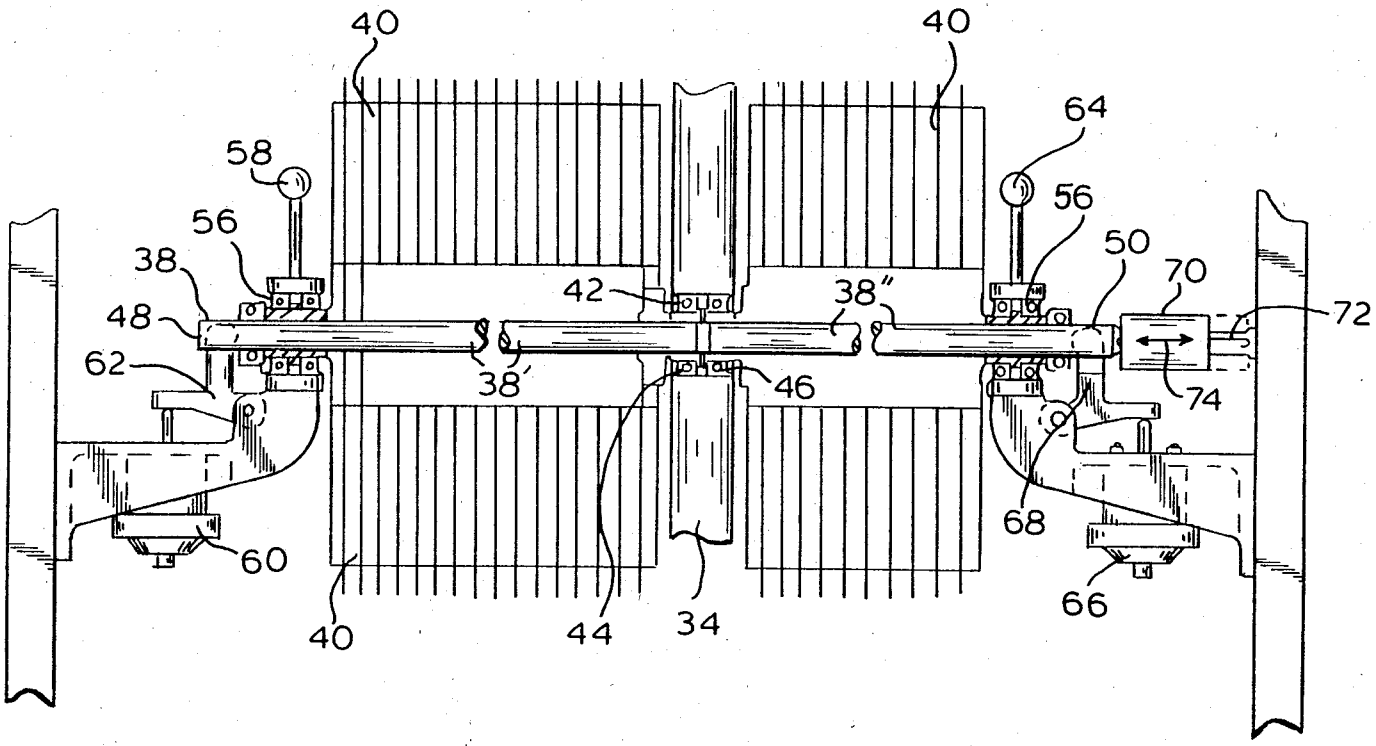
FIG. 2 shows a spindle of the device mounted at the winding station.
Figure 4:
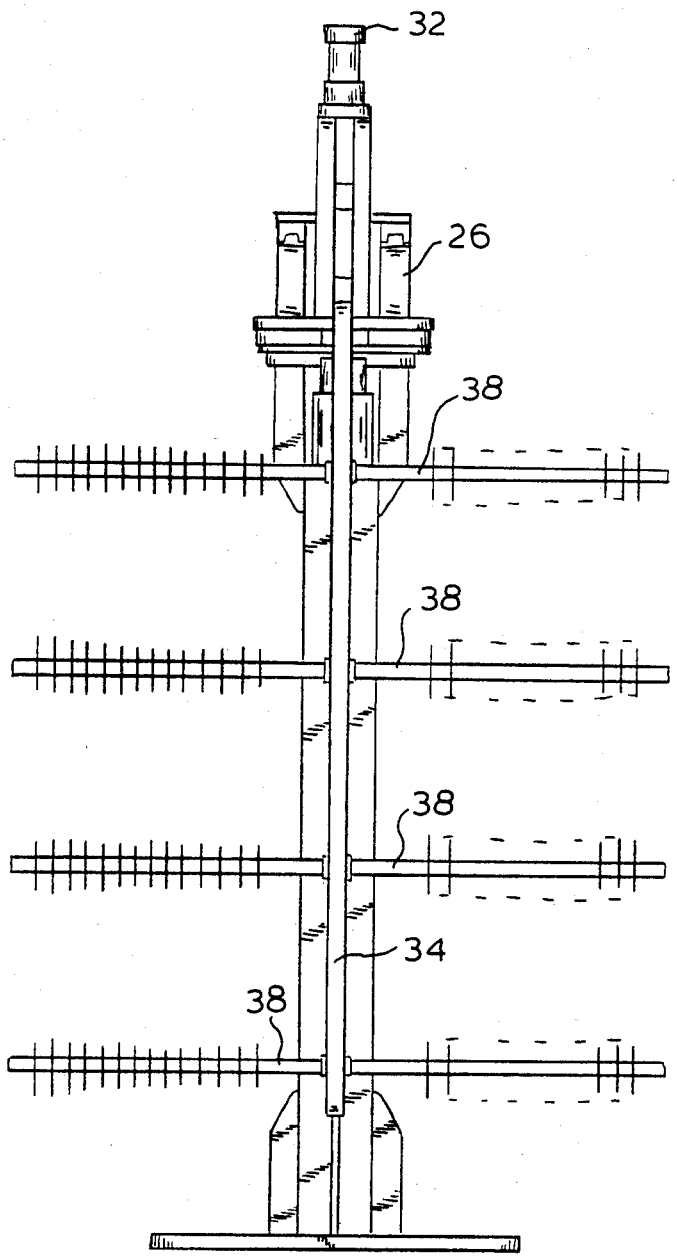
FIG. 4 shows a side view of the device of FIG. 1 with the spindles with empty reels taken along lines 4—4.

As shown more clearly in FIGS. 2 and 4, each spindle holder comprises a vertical bar 34, 36 with a plurality of rotatable spindles 38 extending through the bars 34, 36. Each spindle has two portions 38', 38'', said portions having a length necessary to support a number of tape reels 40. Details of the manner in which each spindle 38 is mounted to one of the spindle holder bars 34 are shown in FIG. 2. The bar 34 has a horizontal hole 42 which houses two roller bearings 44 and 46 which support spindle 38. Each spindle 38 has two extreme ends 48 and 50.

In FIG. 1, spindle holder 24 is at the winding station so that tapes 52 slit from a sheet 54 are wound on reels 40 as shown. On the spindles 38, removable bearing assemblies 56 are provided which consist of radial ball bearings with extended inner races and thrust ball bearings. These assemblies are placed on spindles 38 and against reels 40. Pivoting levers 62 and 68, by the extension of air cylinders 60 and 66, tightly clamp bearing assemblies 56 and reels 40 axially against a central spindle shoulder to prevent the reels from slipping on the spindles during rotation.

Bearing assemblies 56 are gripped by split clamps 58 and 64 which hold free spindle ends 48 and 50 (see FIG. 2).

Above air cylinder 66 there is also a coupling 70 mounted on a motor shaft 72. Coupling 70 is actually slidable on the shaft 72 as indicated by arrow 74. Coupling 70 engages free end 50. In this position the rotary motion of the shaft 72 is transmitted to spindle 38 thereby turning reels 40. As the coupling 70 moves to the right it is disengaged from spindle end 50.

The tape winder operates as follows. Initially one of the spindle holders, such as 24 is positioned at the winding station with all its spindles 38 being locked into corresponding clamps and engaged by couplings for rotation. Thus tapes 52 slit from one or more sheets 54 may be wound on the reels of spindle holder 24. When the reels are filled up with tape, the slitting operation is temporarily halted. The couplings 70 are moved to disengage from the spindles 38 and the spindles are released by disengaging clamps 58 and 64. Next, air cylinder 30 is operated upward to lift the spindles off the clamps. At the same time air cylinder 32 is also activated to lift the spindles of holder 26 which have been previously loaded with empty reels. Once the spindles clear the clamps 58, 64 cylinder 28 is activated to retract the spindle holders radially toward post 12, as indicated by arrows 78 in FIG. 3.

This radial shift allows the spindle holders to clear the winding and unloading station.

When the spindle holder 24 reaches the position 24' (FIG. 1) motor 20 is activated to turn bars 14 and 16 and the spindle holders 24 and 26 by 180° so that the spindle holder 24 reaches position 24'' in FIG. 1. Thus the positions of the two spindle holders 24 and 26 have been reversed.

Next, cylinder 28 is activated to shift the spindle holders 24, 26 radially away from post 12 until they are disposed at the unloading and winding station respectively and then cylinders 30 and 32 are activated to lower the spindle holders thereby positioning the spindle of holder 26 on the clamps of the winding station. The clamps are then closed, the couplings 70 are shifted axially for rotational engagement of the spindles, cylinders 60 and 66 are actuated to operate levers 62 and 68, thus holding the reels, and the reels on spindle holder 26 are ready for tape winding. While the reels of spindle holder 26 are taking on tapes, the reels on holder 24 are unloaded. After the reels of holder 26 are filled with tape the whole operation is repeated.

Obviously, numerous modifications may be made to the invention without departing from its scope as defined in the appended claims. For example, the number of spindle holders may be increased and several winding and/or unloading stations may be disposed radially around the post.

What is claimed is:

1. A winder for winding several tapes simultaneously comprising:

a vertical post;

horizonal support means rotatably mounted on said post for rotation around a vertical axis; and first and second spindle holding means mounted on said support means for holding reels each including a vertical arm supported by said horizontal support means and a plurality of spindles mounted on said arm rotatable around horizontal axes for holding reels;

whereby one of said first and second spindle holding means may be positioned at a winding station for winding tapes on reels while the other spindle holding means may be positioned at an unloading station for replacing full reels with empty reels, after which the positions of said first and second holding means may be reversed by rotating said horizontal support means.

2. The winder of claim 1 wherein said vertical members are slidably mounted on said horizontal support means, said winder further comprising means for selectively shifting said vertical members radially toward and away from said vertical post.

3. The winder of claim 1 wherein each said first and second spindle holding means comprises means for selectively shifting said spindles vertically.

4. The winder of claim 1 wherein said plurality of spindles are arranged in pairs, a spindle of each pair being arranged to rotate around a common horizontal axis, and being disposed on opposite sides of said arms.

5. An apparatus for winding several tapes simultaneously comprising:

a vertical post;

a winding station;

an unloading station;

a horizontal support member mounted on said post and having first and colinear horizontal arms, said members being rotatable around a vertical axis for moving said arms between said winding and unloading station;

first and second spindle holding means supported by first and second horizontal arms respectively;

spindles mounted on said spindle holding means for supporting reels said spindles being rotatable around respective horizontal axes; and means for turning said spindles for winding tapes.

6. The apparatus of claim 5 further comprising a motor for turning said horizontal support member.

7. The apparatus of claim 5 wherein said first and second spindle holding means comprises a vertical element and said spindles are mounted on said vertical element.

8. The apparatus of claim 7 wherein each spindle has a central portion engaged by said vertical element and two spindle ends.

9. The apparatus of claim 8 wherein said winding station comprises stationary bearing clamp means for engaging the spindle ends positioned at the winding station.

10. The apparatus of claim 9 where said winding station further comprises a rotating shaft and coupling means which are slidable for engaging one of said spindle ends and coupling said one spindle end to said rotating shaft.

11. The apparatus of claim 9 wherein said stationary bearing clamp means include split clamps and said spindle holding means include means for lifting said spindles for disengagement from said stationary bearing clamps.

12. The apparatus of claim 10 further including means for shifting said spindle holding means radially towards or away from said post.

* * * * *

UNITED STATES PATENT AND TRADEMARK OFFICE

CERTIFICATE OF CORRECTION

PATENT NO. : 4,597,542

DATED : July 1, 1986

INVENTOR(S) : ROBERT J. LeFRANK

It is certified that error appears in the above-identified patent and that said Letters Patent is hereby corrected as shown below:

Column 3, lines 50-51, "members" should be --arms--.

Signed and Sealed this

Twenty-eighth Day of October, 1986

[SEAL]

*Attest:*

DONALD J. QUIGG

*Attesting Officer*

*Commissioner of Patents and Trademarks*